United States Patent [19]

Morris

[11] Patent Number: 4,656,567

[45] Date of Patent: Apr. 7, 1987

[54] INDISCERNIBLE LAMP

[75] Inventor: John R. Morris, Birmingham, England

[73] Assignee: Lucas Industries PLC, Birmingham, England

[21] Appl. No.: 659,836

[22] Filed: Oct. 11, 1984

[30] Foreign Application Priority Data

Oct. 14, 1983 [GB] United Kingdom ..... 8327529

[51] Int. Cl.[4] ..... F21V 9/08

[52] U.S. Cl. ..... 362/231; 362/268; 362/293

[58] Field of Search ..... 362/268, 293, 230, 231

[56] References Cited

U.S. PATENT DOCUMENTS

| | | | |
|---|---|---|---|
| 1,930,774 | 10/1933 | Scherfee | 177/327 |
| 2,345,777 | 4/1944 | Somers | 362/293 |
| 3,514,589 | 5/1970 | Huber | 362/293 |
| 4,241,388 | 12/1980 | Green | 362/293 |

FOREIGN PATENT DOCUMENTS

| | | |
|---|---|---|
| 0081361 | 6/1983 | European Pat. Off. . |
| 1655784 | 8/1971 | Fed. Rep. of Germany . |
| 2522391 | 9/1983 | France . |

*Primary Examiner*—Andrew M. Dolinar
*Attorney, Agent, or Firm*—Holman & Stern

[57] ABSTRACT

A lamp which is designed to emit light of a specified color comprises a housing having a light-transmitting front cover which is juxtaposed to a colored decorative panel. One or more optical filters are disposed within the housing. The optical filters are positioned in the housing so as to intercept light before it is emitted through the front cover. Each filter colors the light in a mixture of said specified color and a color which is complementary to that of said front cover.

4 Claims, 1 Drawing Figure

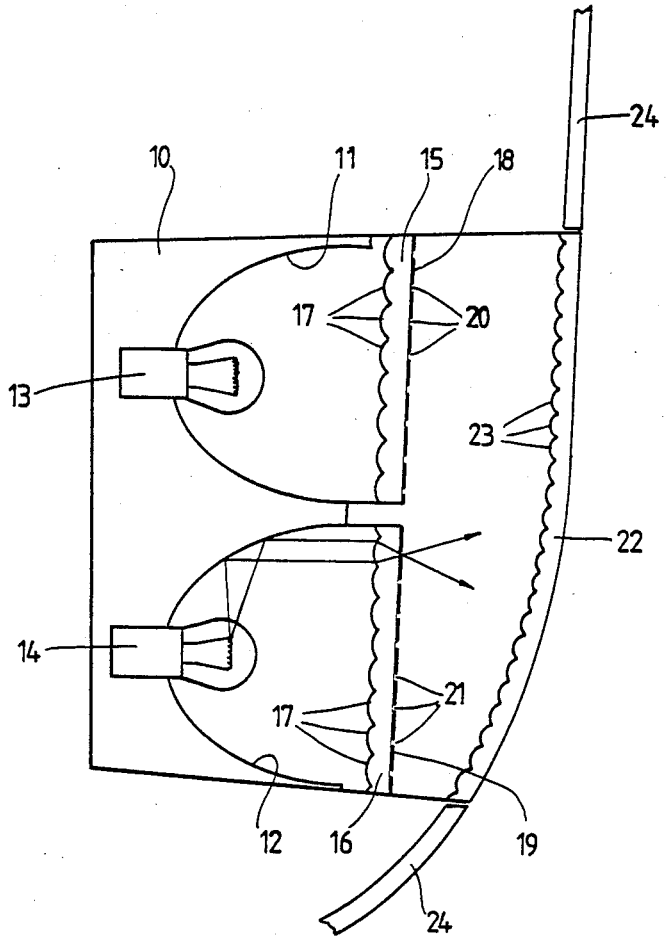
24
10
11
15
18
17
20
13
23
22
14
21
17
12
16
19
24

INDISCERNIBLE LAMP

This invention relates to an indiscernible lamp, i.e. a lamp which gives the appearance of being a decorative panel or the like until it is actually energised.

Recent design trends, particularly in relation to motor vehicles, have been towards lamps which when de-energised have an appearance similar to that of adjacent decorative panels or the like. Since such decorative panels are usually coloured, it is often the case that the lamp must appear to be of one colour when de-energised and must emit light of a different colour when energised. In certain applications it is important that the colour of the light emitted by the energised lamp should not be influenced by the colouration of the lamp when de-energised: for example, vehicle lamps must emit light having a chromaticity which falls within specific limits in order to satisfy various legal requirements, and it is unacceptable that this chromaticity should be affected by the colouration of the de-energised lamp.

A lamp of this general type is disclosed in U.S. Pat. No. 4,041,302, wherein a coloured filter having a semi-reflecting coating on one of its surfaces is disposed behind a front cover of the lamp. When the lamp is not energised, the semi-reflecting coating reflects through the front cover the colouration of a surface within the lamp, this colouration being the same as that of an adjacent body panel of the vehicle on which the lamp is mounted. When the lamp is energised, light from an incandescent bulb passes through the coloured filter and its semi-reflecting coating and is emitted from the lamp.

Although this arrangement is effective to a certain extent, it still suffers from a number of disadvantages. More particularly, if the lamp is energized in bright daylight conditions, ambient light entering the lamp and falling on the coloured surface will be reflected by the semi-reflecting coating and will be re-emitted along with the light from the energised bulb. Consequently, the colouration of the coloured surface may affect the overall chromaticity of the light emitted from the lamp. In addition, because of the need to provide a coloured surface of substantial area within the interior of the lamp, the overall bulk of the lamp is increased and therefore this particular design of lamp is not suitable for use where space for its accommodation is limited. Moreover, due to the fact that a semi-reflecting coating is used, the intensity of the light emitted by the bulb will be reduced by half or thereabouts before it is actually emitted from the lamp. To maintain the light output at the legal level required it becomes necessary to increase the efficiency and/or size of a reflector of the lamp, which in turn makes the lamp more expensive to produce and can also give rise to heat dissipation problems. Furthermore, the appearance of the lamp when de-energised is not particularly consistent with that of the adjacent decorative panels because some of the ambient light entering the lamp will be reflected internally by the front cover, so that the light emerging from the de-energised lamp will be a combination of this reflected light and the light which has been coloured by the aforementioned coloured surface. In other words, the colour of this light is markedly desaturated.

It is an object of the present invention to overcome the disadvantages noted above.

According to the present invention, there is provided a lamp designed to emit light of a specified colour, comprising a housing having a light-transmitting front cover which, in use, is juxtaposed to a coloured decorative panel or the like and optical filter means which is positioned in the housing so as to intercept light before it is emitted through the front cover and which colours said light in a mixture of said specified colour and a colour which is complementary to that of the cover.

Conveniently, the front cover is tinted to match the colour of the decorative panel.

Preferably, the lamp is of the general type disclosed in our UK Pat. No. 1591013 i.e. it comprises a lens element positioned within the housing and a baffle disposed between the lens element and the cover, the cover itself being provided with lensing so that it forms an additional lens element. The first mentioned lens element includes a multiplicity of individual lenses, and the baffle has a plurality of light transmitting portions each of which is disposed on the optical axis of a respective one of those lenses, the remainder of the baffle being light-absorbing or opaque. Each of the individual lenses is arranged to focus a pencil of light rays through the respective light-transmitting portion of the baffle, and each light-transmitting portion is limited in its extent to that necessary to transmit substantially the whole of the pencil of light rays. In this case, the baffle is advantageously coloured on a surface thereof which faces the front cover in substantially the same colour as said panel.

The invention will now be further described, by way of example only, with reference to the single FIGURE of the accompanying drawing, which is a schematic plan view of a lamp according to the present invention. The lamp actually illustrated is in the form of a combined indicator/reversing unit for mounting on a road vehicle, although it is to be appreciated that the invention is applicable to many other types of lamp apart from this.

The illustrated lamp comprises generally a housing 10 within which are contained a pair of reflectors 11, 12 in side-by-side relation, each reflector having an associated incandescent bulb 13, 14. Each reflector 11, 12 is overlain by a respective lens element 15, 16 having a multiplicity of individual lenses 17 thereon. A baffle 18, 19 is mounted on a side of each lens element 15, 16 remote from the respective reflector 11, 12 and comprises a plurality of light-transmitting portions or interstices 20,21 each of which is disposed on the optical axis of a respective one of the lenses 17, the remainder of the baffle being opaque. Each of the lenses 17 is arranged (as indicated by arrows) to focus a pencil of light rays reflected by the reflector 11, 12 through the associated baffle interstice 20,21, the latter being limited in its extent to that necessary to transmit substantially the whole of the respective pencil of light rays. The whole assembly is covered by a transparent or translucent front cover 22 which forms an external surface of the lamp, the cover being provided with lensing 23 so that it acts as a further lens element to re-direct and/or redistribute the divergent light rays emerging from the baffles 18 and 19.

As is explained in greater detail in the above-mentioned UK Pat. No. 1591013, this particular arrangement provides a high contrast between the light emitted by the lamp when either bulb 13, 14 is energised and extraneous light which enters the lamp from outside, is reflected internally and is re-emitted. In addition, the baffle serves to hide the internal components of the lamp and imparts a pleasing appearance to the lamp as a whole.

Reference numeral 24 indicates body panels of the vehicle on which the lamp is mounted, which panels are of a particular colour. In order that the lamp when de-energised blends in with these panels and itself gives the appearance of being a body panel, the front cover 22 is tinted in the same colour as that of the body panels. The baffles 18 and 19 may also be similarly coloured on their surfaces which face the front cover 22, although this is not essential particularly where the body panels 24 are of a light colour.

The reflector 11, bulb 13, lens element 15 and baffle 18 together form a reversing lamp unit which should emit substantially colourless (i.e. "white") light, while the reflector 12, bulb 14, lens element 16 and baffle 19 together form a direction indicator lamp unit which should emit amber light. If the lens element 15 were to be colourless and the lens element 16 were to be amber, then the light emitted by the lamp units after passing through the cover 22 would be tainted by the colouration of the cover and would in all likelihood not comply with the appropriate legal requirements concerning chromaticity. To correct this, therefore, each of the lens elements 15 and 16 is coloured in a mixture of the desired colour for the particular lamp function and a colour which is complementary to that of the cover 22. The colouration of the cover 22 and the complementary colour in the lens element will cancel each other out, leaving only the desired colour in the light emitted by the lamp. Although a slight loss in intensity will be experienced, this will not be anywhere near as great as that suffered due to the presence of a semi-reflecting coating in the above-mentioned U.S. Patent.

In a specific example, where the body panels 24 are red the cover 22 will have the following trichromatic coordinates (using *C.I.E. standard illuminant "A"=2854K):

$x=0.510$ $y=0.393$

*C.I.E.—Commission International de L'Eclairage)

The reversing lamp unit will require a compensating lens element 15 with the following co-ordinates:

$x=0.384$ $y=0.420$ so that the light emitted is within the limits $y=0.31+0.25x$ $y=0.28+0.25x$ $x=0.50$ $x=0.41$ The direction indicator lamp unit will require a compensating lens element 16 with the following co-ordinates:

$x=0.555$ $y=0.443$ so that the light emitted is within the limits y greater than or equal to 0.398
y less than or equal to 0.429
z less than or equal to 0.007

It is to be appreciated that the lens elements 15 and 16 need not themselves be coloured: instead, the necessary colouration could be obtained by means of a separate filter inserted between each lens element and the associated reflector. It will also be appreciated that the principles of the invention can be applied to any of the vehicle lamps and not just the reversing and direction indicator units. Furthermore, although the invention has been described above in relation to a lamp of the general type disclosed in U.K. Pat. No. 1591013, it will be manifest that the invention is also applicable to lamps which are not of this type.

Also it will be appreciated that as the colour of the limited front cover is chosen to give a pleasing visual effect the colour chosen may be different to that of the coloured decorative panel and conveniently may be a contrasting colour to the colour of the decorative panel.

I claim:

1. A lamp assembly comprising a housing having a pair of juxtaposed internal lamps for emitting light of respectively different colours, a light-transmitting front cover of substantially uniform colour for imparting a desired colour appearance to the assembly when neither lamp is energized, and a pair of respectively differently coloured optical colour filters in the housing for intercepting light from the respective lamps before the light is transmitted through the front cover, and for colouring the light in a mixture of the light colour emitted from the front cover by the respective lamp and a colour complimentary to the colour of the front cover.

2. A lamp assembly as claimed in claim 1 wherein each colour filter includes a lens element positioned within the housing and a baffle disposed between the lens element and the cover, the cover itself being provided with lensing so that it forms an additional lens element.

3. A lamp assembly as claimed in claim 2 wherein the first mentioned lens element includes a multiplicity of individual lenses, and the baffle has a plurality of light-transmitting portions each of which is disposed on the optical axis of a respective one of those lenses, the remainder of the baffle being light-absorbing or opaque.

4. A lamp assembly as claimed in claim 3 wherein each of the individual lenses is arranged to focus a pencil of light rays through the respective light-transmitting portion of the baffle, and each light-transmitting portion is limited in its extent to that necessary to transmit substantially the whole of the pencil of the light rays.

* * * * *